US006910592B1

(12) United States Patent
Lindenmeyer

(10) Patent No.: US 6,910,592 B1
(45) Date of Patent: Jun. 28, 2005

(54) FISHING ROD STORAGE DEVICE

(76) Inventor: Richard Lindenmeyer, 25510-D Hemingway Ave., Stevenson Ranch, CA (US) 91381

( * ) Notice: Subject to any disclaimer, the term of this patent is extended or adjusted under 35 U.S.C. 154(b) by 0 days.

(21) Appl. No.: 10/396,588

(22) Filed: Mar. 24, 2003

(51) Int. Cl.[7] ..... A47F 7/00
(52) U.S. Cl. ..... 211/70.8; 211/60.1; 224/922
(58) Field of Search ..... 211/70.8, 60.1, 211/70.6, 89.01; 224/922

(56) References Cited

U.S. PATENT DOCUMENTS

| | | | | | |
|---|---|---|---|---|---|
| 350,523 | A | * | 10/1886 | Bodley | 211/65 |
| 1,706,683 | A | * | 3/1929 | Victorsohn | 248/251 |
| 2,797,851 | A | * | 7/1957 | Leake | 224/482 |
| 3,291,427 | A | * | 12/1966 | Hutchings | 211/70.8 |
| 3,297,166 | A | * | 1/1967 | Summers | 211/60.1 |
| 4,628,628 | A | * | 12/1986 | Burgin et al. | 211/70 |
| 5,094,351 | A | * | 3/1992 | Barney | 211/70.8 |
| D378,482 | S | * | 3/1997 | Hall et al. | D6/552 |
| 5,678,348 | A | * | 10/1997 | Zielinski et al. | 211/70.8 |
| 6,109,459 | A | * | 8/2000 | Downey | 211/70.8 |
| 6,471,103 | B1 | * | 10/2002 | Frese et al. | 224/200 |
| 6,510,953 | B2 | * | 1/2003 | Daniels | 211/60.1 |

* cited by examiner

*Primary Examiner*—Robert W. Gibson, Jr.
(74) *Attorney, Agent, or Firm*—Gary Schnittgrund

(57) ABSTRACT

A fishing rod storage device and method for storing and carrying fishing rods such that the rods are held in a stable configuration without allowing the rods to touch each other, thereby avoiding damage during storage or transport. The device includes two racks, each having a paired plurality of holes and slots for accepting the rod tip and handle. The slots are preferably T-shaped. The rod storage rack allows fishing rods to be stored vertically by mounting on a wall or horizontally by mounting on a wall or a ceiling, for example. A retainer cord holds the fishing rods securely in the storage device to prevent accidental displacement during storage. The portable fishing rod storage rack typically includes two elastic cylindrical bodies each having a plurality of indentations or grooves which accept the rod element of the fishing rod and which are made of a plastic foam material that retains as many as about eight fishing rods. The rods are securedly held in alignment with one strap on each cylindrical body, such that the rods may be carried by one person without entanglement of the lines or hooks and without the rods touching each other, thereby avoiding damage during transport.

9 Claims, 2 Drawing Sheets

FISHING ROD STORAGE DEVICE

FIELD OF THE INVENTION

This invention relates to a device and method of storing fishing rods for long-term storage and during transport.

BACKGROUND OF THE INVENTION

A fisherman's collection of fishing rods and reels may be worth thousands of dollars. Fishermen have been stacking fishing rods in the corner of the garage for decades. Known fishing rod storage racks are one-dimensional, meaning they can only store fishing rods vertically, or horizontally, and only on a floor, wall, or a ceiling. Many known fishing rod storage racks are limited to a low number of rods that can be secured. Some can't store rods with the reels attached. Many storage devices are capable of storing only a limited size fishing rod. Other storage racks require assembly.

Another issue is how to store rods in both stationary and transportable locations. Transportable locations include, but are not limited to a vehicle, boat, recreational vehicle, or camper. Stationary locations include, but are not limited to, a garage, boathouse, attic, or shed.

Fishermen have long had issues with wrapping fishing rods together when going on a fishing trip. The only known rod carriers that are available on the market utilize small straps and usually attached with VELCRO®, where the straps wrap the rods together, binding each to the other. This causes the surface of the rods and eyes of the rods to rub against each other. This rubbing causes scratches and chips in the rods, and can cause a fishing rod to be weakened or to break. This sort of rod wrapping provides no protection for rods, from the rip to the butt of the rod.

Another common transport container is the rod tube. When transporting fishing rods in a rod tube, the rods bounce around inside the tube causing damage to rods while in transit.

What is needed is a device to enable safe transport and secure storage of fishing rods without damaging the rods.

SUMMARY OF THE INVENTION

The apparatus of the instant invention is a fishing rod storage device comprising two mounting racks that are configured to allow one or more fishing rods to be placed in it. There is also a series of holes and slots that allows a fishing rod to be placed therein, the holes and slots being aligned between the racks such that a fishing rod is put into a preferred alignment between the two racks. The racks are mountable to a stationary fixture, such as a wall, ceiling, or truck body.

The novel features of the invention are set forth with particularity in the appended claims. The invention will be best understood from the following description when read in conjunction with the accompanying drawings.

OBJECTS OF THE INVENTION

It is an object of the invention to store fishing rods securely on a wall or ceiling of a house or transportation vehicle.

It is an object of the invention to provide a device to hold fishing rods in a stable and protective manner while transporting the rods.

Other objects, advantages and novel features of the present invention will become apparent from the following detailed description of the invention when considered in conjunction with the accompanying drawing.

DETAILED DESCRIPTION OF THE PREFERRED EMBODIMENT

The disclosed fishing rod storage devices are versatile, and are capable of storing rods horizontally overhead, on a wall, or at floor level at any angle, as well as vertically. The fishing rod racks are one piece, so there's no assembly required and the racks are modularly designed, providing unlimited rod storage capability with or without the reels attached. The fishing rod racks secure any size fishing rod. The 90-degree bend at the top of the rack acts as the mounting bracket and provides stability to the entire rod rack. Additionally, the rack allows the mounting bracket to be flexible, providing the capability to be mounted to a flat, convex, or concave surface. The racks may utilize a retainer cord. The cord secures the fishing rods in place by being placed below the rods while the rods are in the rod racks, thereby preventing rods from falling out of the rack, or, alternately, by placing the cord over the rods, pushing the rods down on the fishing rod rack.

Figure 1:
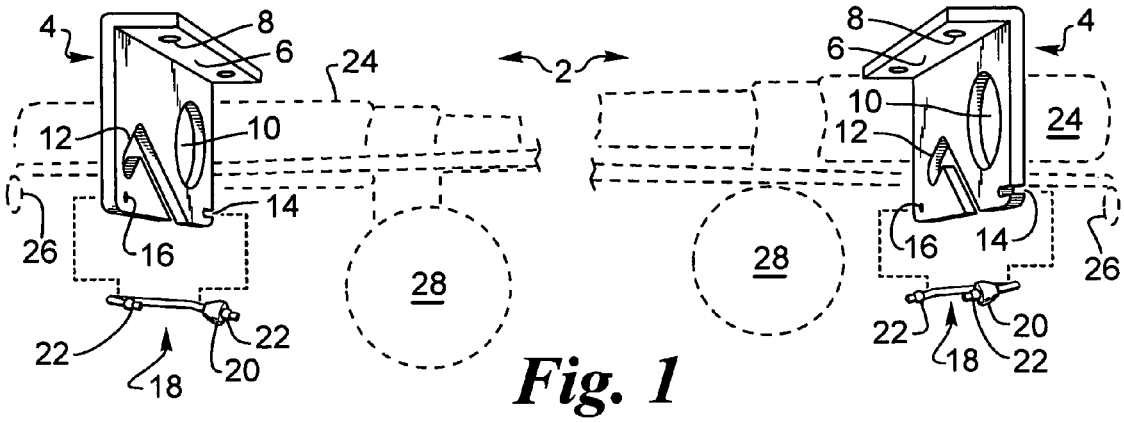
FIG. 1 is a perspective oblique view of a two-rod embodiment of the fishing rod storage rack mounted on an overhead horizontal surface.

FIG. 1 is a perspective oblique view of a two-rod embodiment of the fishing rod storage rack generally indicated 2, comprising a pair of racks 4 and a pair of retainer cords 18. Each rack has a rod grip hole 10 and a rod tip slot 12. Each rack has a mounting flange 6 having two or more countersunk bores 8 for mounting fasteners (not shown). Two fishing rods (shown in phantom by dashed lines) illustrate how rod grips 24 fit in rack holes 10, and rod tips 26, with finish guides, lie in slots 12. The alternating grip-tip arrangement of fishing rods allows more space for fishing reels 28.

One end of optional retainer cord 18 is affixed in hole 16 by means of a ferrule or knot 22, and at the opposite end, is affixed to a pull knob 20 using another ferrule or knot 22. Rod tip slot 12 is closed, to prevent rod tip 26 from inadvertently falling from rod tip slot 12, by stretching retainer cord 18 by pull knob 20 until the cord slideably engages slot 14. Retainer cord 18 is made of elastic cord-like material, inexhaustibly including fabric covered stranded rubber, bungee cord, or shock cord.

The embodiment shown accommodates two fishing rods, whereas it is intended that the scope of the present invention further include any even number of fishing rods. A rack may be made of a variety of materials, inexhaustibly including ABS (poly-acrylonitrile butadiene styrene), acrylics, PVC (poly-vinyl chloride) and such like. Rack 2 may be pigmented white or another color. Preferred manufacturing methods include injection molding, casting, high-density foam molding, extruding with secondary operations, and routing from sheet stock with welded or adhesively bonded miter joint.

Figure 2:
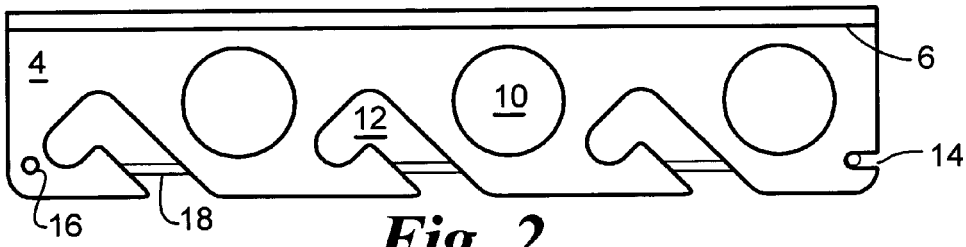
FIG. 2 shows an elevation view of a six-rod embodiment intended for ceiling mount.

FIG. 2 shows an elevation view of a six-rod embodiment intended for ceiling mounting. After releasing retainer cord 18 (not shown), a rod tip is inserted in slot 12 until it lies in the toe of the slot 12. The retainer is closed by engaging slot 14 in order to prevent dislodgement of a rod tip due to vibration, earthquake, capsizing, or other catastrophe.

Figure 3:
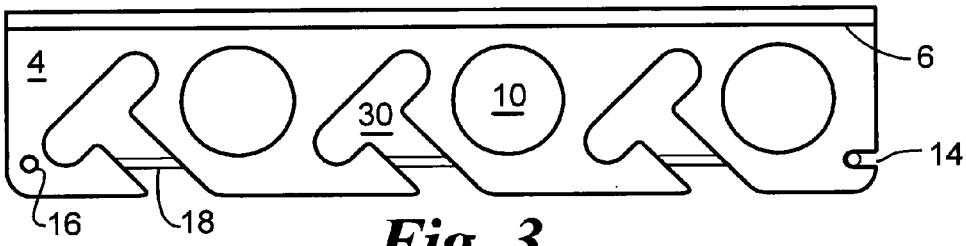
FIG. 3 is an elevation view of a six-rod embodiment suitable for mounting on a ceiling or on an up-facing horizontal surface.

FIG. 3 is an elevation view of a six-rod embodiment suitable for mounting on a ceiling, on an upward-facing horizontal surface, or on a vertical surface. Rod tip slots 30 have T-shaped terminations to hold a rod tip without regard to the orientation of the rack. Other numeric designators indicate previously described features.

Figure 4:
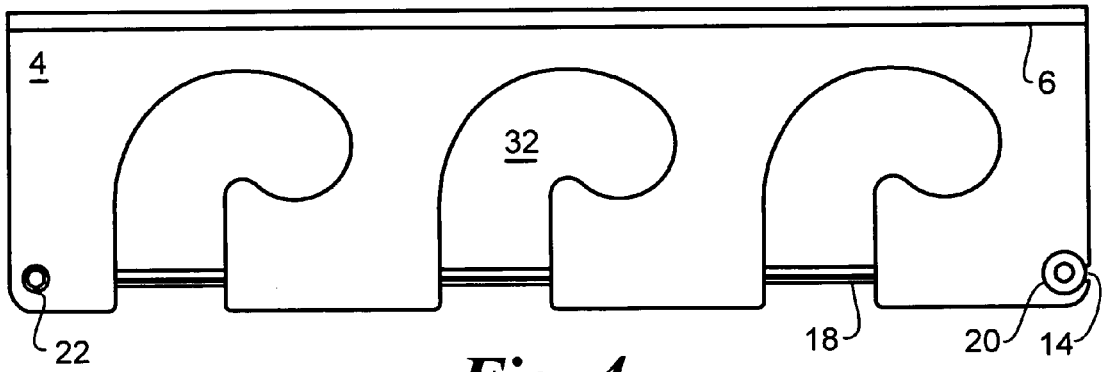
FIG. 4 shows a three-rod, ceiling-mounted embodiment having grip slots.

FIG. 4 shows a three-rod, ceiling-mounted embodiment having grip slots 32 that are sized to accommodate fishing rod grips of the conventional diameter. Retainer cord 18 is shown installed and in the retaining position. Other numeric designators indicate previously described features.

Figure 5:
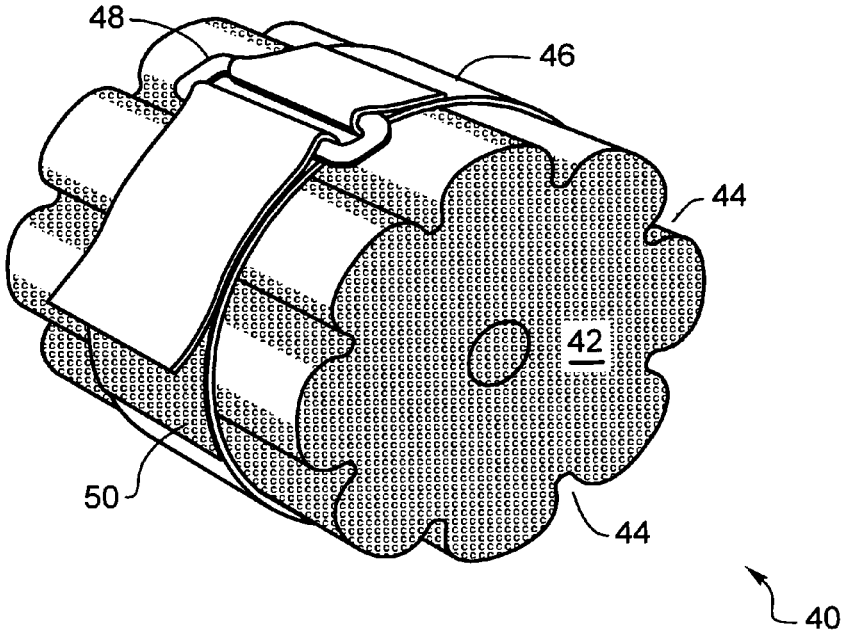
FIG. 5 is a perspective oblique portion view of a portable fishing rod storage rack.

FIG. 5 is a perspective oblique view of one of two assemblies comprising a portable fishing rod storage rack generally indicated 40. This embodiment of the fishing rod storage rack is also called a sepoleator 40. The sepoleator 40 comprises an elastic cylindrical body 42 having two or more grooves 44 in the cylindrical surface, and a strap 46 compressibly affixed to body 42 by means of buckle 48 and hook or pile fastener 50. The sepoleator 40 is preferably between approximately 2 and 10 inches in length. Its diameter determines how many fishing rods can be retained, and in a preferred embodiment is about 3 inches in diameter.

In a further alternative embodiment, the cylindrical body 42 further comprises a central axial hole 52 through which is affixed a loop of ropelike material (not illustrated) in order to carry and hang the assembly. The central axial hole 52 increases the elastic compliance of body 42 in order to better grip the shafts and tips of fishing rods.

Preferred materials for body 42 inexhaustibly include EVA foam, closed cell foamed polyethylene, and closed cell foamed flexible polyurethane. Preferred methods of manufacture include extruded-profile foam bars cut to length, low-pressure steam molding, and low-pressure reactive molding. The materials of choice are preferably environmentally stable and resistant to salt water and to ultraviolet radiation.

Figure 6:
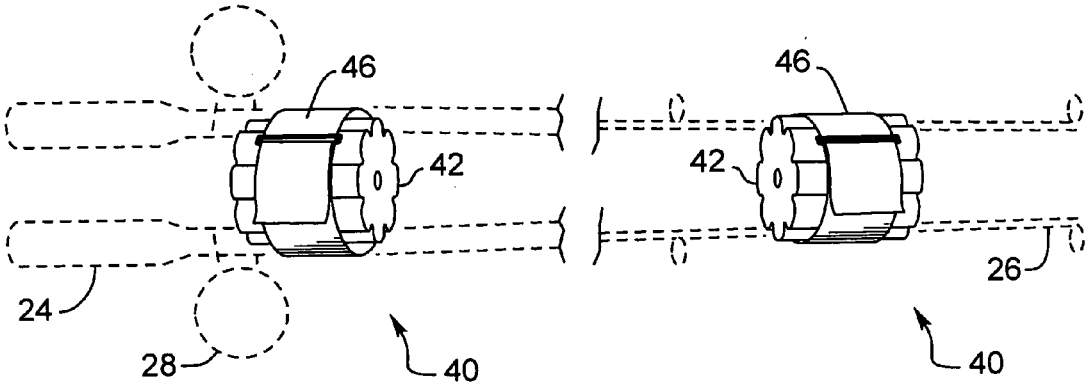
FIG. 6 provides a perspective view of a portable fishing rod storage rack with rods shown in phantom.

FIG. 6 provides a perspective view of the portable fishing rod storage rack 42 with two fishing rods (shown in phantom by dashed lines) affixed in the grooves of body 42 by straps 46. Body 42 is sufficiently compressible to retain rod tips 26 when strap 46 is tightened. Strap 46 is made long enough to retain a fishing rod shaft in each slot of body 42. The embodiment shown in FIGS. 5 and 6 may accommodate eight fishing rods, whereas only two are indicated for clarity. When the portable storage carrier is fully loaded, there is sufficient clearance around the periphery for all the reels 28. The assembly is preferably carried by using a grip 24 as a handle, or by grasping the shaft of one of the rods. Alternative embodiments have more or fewer slots for fishing rods.

The sepoleator 40 enables safe transport in a rod tube as well (not illustrated). In an alternative embodiment, up to 8 rods may be secured with the reels attached. When the rods are secured in place, the eyes on the rods are turned inside, toward each other, and away from the exterior of the rod tube. The rods then slide into the tube securely. The sepoleator 40 prevents the rods from moving around inside the rod tube. An optional embodiment is to secure the rods with the sepoleator 40, and then place the secured rods in a bag, before inserting them into the rod tube.

Obviously, many modifications and variations of the present invention are possible in light of the above teachings. It is therefore to be understood that, within the scope of the appended claims, the invention may be practiced otherwise than as specifically described.

What is claimed is:

1. A fishing rod storage device comprising:

a first rack and a second rack;

retainer means in said first rack that are configured to allow a fishing rod to be placed therein;

retainer means in said second rack that are configured to allow a fishing rod to be placed therein, said retainer means in said second rack being aligned with said retainer means in said first rack, thereby putting a fishing rod placed therein in a preferred alignment between said first rack and said second rack;

a mounting means for attaching said first rack and said second rack to a stationary fixture;

said retainer means in said first rack comprising a grip hole and a T-shaped slot, and said retainer means in said second rack further comprising a T-shaped slot and a grip hole, wherein said first rack grip hole is aligned with said second rack slot.

2. The fishing rod storage device according to claim 1, wherein said first rack is further comprised of a mounting flange at right angle to said first rack.

3. The fishing rod storage device according to claim 1, further comprising a retainer cord means for retention of the fishing rods.

4. The fishing rod storage device according to claim 3, wherein said retainer cord means is an elastic strap.

5. The fishing rod storage device according to claim 1, wherein said mounting means is a flange having attachment holes therein.

6. The fishing rod storage device according to claim 1, further comprising a retainer slot and a retainer hole to facilitate retention.

7. The fishing rod storage device according to claim 1, wherein said first rack and said second rack are flexible providing the capability to be mounted to a flat, convex, or concave surface.

8. A method of storing a fishing rod comprising the steps of:

selecting a first rack having at least one grip hole and at least one T-shaped slot together with an integral mounting flange;

selecting a second rack having at least one grip hole and at least one T-shaped slot together with an integral mounting flange, wherein said first rack grip hole is aligned with said second rack slot and said first rack slot is aligned with said second rack grip hole;

mounting said first rack and said second rack parallel to each other on a wall at a distance apart that is less than the length of a first or a second fishing rod that is to be placed therein;

selecting the first fishing rod having a first fishing rod grip and a first fishing rod tip to be mounted between said first rack and said second rack;

placing the first fishing rod grip in said grip hole in said first rack;

placing the first fishing rod tip in said slot in said second rack;

selecting a second fishing rod having a second fishing rod grip and a second fishing rod tip;

placing the second fishing rod grip in said grip hole in said second rack;

placing the second fishing rod tip in said slot in said first rack;

placing a retainer cord across the mounted fishing rod and at a right angle thereto; and stretching said retainer cord between a retainer hole and a retainer slot on said first rack.

9. The method according to claim 8, wherein said step of placing a retainer cord across the mounted fishing rod and at a right angle thereto is placing said cord over the rods.

* * * * *